US005407469A

United States Patent [19]

Sun

[11] Patent Number: 5,407,469

[45] Date of Patent: Apr. 18, 1995

[54] IMPROVED AIR IONIZING APPARATUS

[75] Inventor: Chien Sun, Los Angeles, Calif.

[73] Assignee: Sunova Company, Los Angeles, Calif.

[21] Appl. No.: 169,018

[22] Filed: Dec. 20, 1993

[51] Int. Cl.[6] ..... B03C 3/41

[52] U.S. Cl. ..... 96/62; 96/63; 96/65; 96/97; 361/226

[58] Field of Search ..... 96/65, 63, 97, 62; 95/78; 361/226, 233, 234; 422/120

[56] References Cited

U.S. PATENT DOCUMENTS

| | | | |
|---|---|---|---|
| 3,411,025 | 11/1968 | Marks | 95/78 X |
| 4,940,470 | 7/1990 | Jaisinghani et al. | 95/78 |
| 4,955,991 | 9/1990 | Torok et al. | 96/97 X |
| 4,976,753 | 12/1990 | Huang | 55/501 X |
| 5,034,032 | 7/1991 | Yikai et al. | 96/97 X |
| 5,035,728 | 7/1991 | Fang | 422/120 X |
| 5,332,425 | 7/1994 | Huang | 361/233 X |

FOREIGN PATENT DOCUMENTS

| | | | |
|---|---|---|---|
| 2646798 | 4/1978 | Germany | 96/65 |

*Primary Examiner*—Richard L. Chiesa
*Attorney, Agent, or Firm*—Gene W. Arant

[57] ABSTRACT

An improved air ionizing apparatus that may be used as part of an air filtering system. The apparatus consists of an air passageway with at least one negatively charged ionizing member therein and a conductive strip, positively charged with respect to the ionizing member extending around at least a major portion of the interior periphery of the outlet of the passageway. The conductive strip attracts the negative ions, causing them to disperse as air directed down the passageway propels them toward and through the outlet of the passageway.

3 Claims, 2 Drawing Sheets

IMPROVED AIR IONIZING APPARATUS

BACKGROUND OF THE INVENTION

The production of a stream of air containing negatively ionized air molecules has proven to be a helpful method for removing dust particles from a room. The ionized air particles ionize dust particles with which they come into contact. The ionized dust particles tend to travel toward and stick to the ceiling and walls of the room which generally bear a slight positive charge.

Unfortunately, until now the inexpensive, simple systems for producing a stream of ionized particles have been of limited effectiveness. There is, therefore, a need for a simple, inexpensive apparatus for producing a stream of air that is densely populated with negatively ionized molecules.

I. REVIEW OF THE PRIOR ART

U.S. Pat. No. 4,976,753 to Huang discloses a housing that may be used with an air filtering system. This disclosure does not address the problem described above, of producing a stream of air densely populated with ionized molecules.

The system disclosed in U.S. Pat. No. 5,035,728 to Fang utilizes at least one negatively charged ionizing needle, about which air is blown. Although this system does produce ionization, it has been found to produce a comparatively "weak" stream of negatively ionized air molecules. There is a need for an improved device for producing a stream of air with a more diffuse distribution of ionized molecules.

A cathode ray tube, well known in the prior art, is a device in which a cathode and an anode with a high magnitude voltage difference create an electron beam. The cathode ray tube, however, is not geared to the solution of the problem described above. The electrons produced are not released into the atmosphere but crash into a screen at the front of the device.

SUMMARY OF THE INVENTION

The present invention comprises a blower for propelling an air stream along a passageway, and a cathode projecting laterally into the passageway for discharging ions into the passageway so that they will flow with the air stream through the passageway output. The improvement which differentiates the present invention from the prior art comprises a strip of positively charged electrically conductive material that extends at least partially around the interior periphery of the passageway outlet. This conductive strip attracts the negatively charged ions in a forwardly direction along with the air movement, and also radially, toward the periphery of the output passageway. Although some ionized air molecules may contact the peripheral strip and thereby become de-ionized, the majority are accelerated forward and outward by the attraction of the conductive strip. A direct voltage of at least several thousand volts is applied between the conductive strip and the cathode, so that a substantial flow of electrons produced from the cathode remains in the air stream flowing through and beyond the passageway output.

DETAILED DESCRIPTION OF THE DRAWINGS

Figure 1:
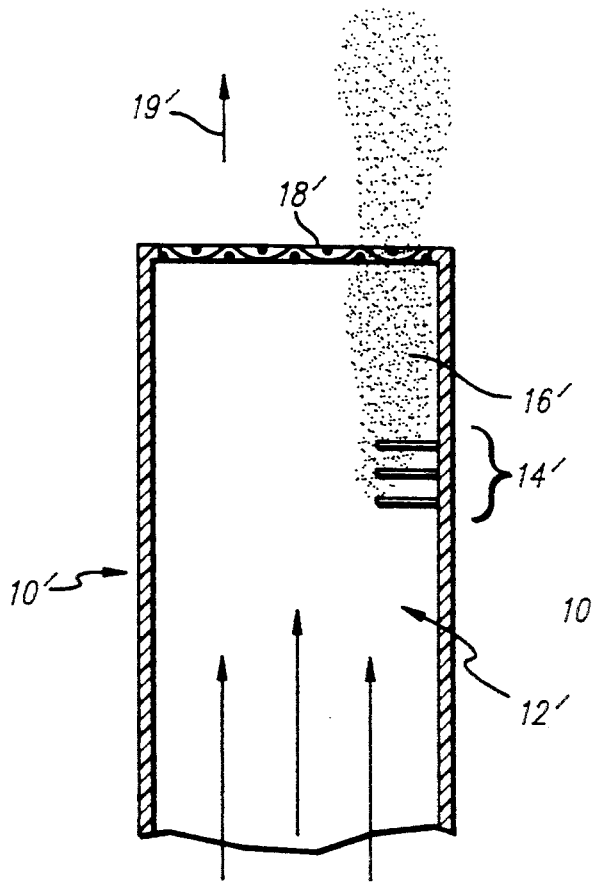
FIG. 1 PRIOR ART
FIG. 1 is an expanded cross-sectional schematic view of the ionizing apparatus of a prior art air filter showing the flow of negatively ionized air molecules bunched in a narrow stream.

FIG. 1 shows an expanded cross-sectional view of a portion of a prior art device 10', comprising the output passageway 12' and the accompanying apparatus for producing a stream of air that includes negative ions. Air is forced into the output passageway where it travels past the three negatively charged ionizing needles 14' producing a cloud of ionized air 16'. Note, however, that this cloud does not disperse before exiting through the output grill 18', and instead exits in a narrow stream. As a result, the output air stream indicated by arrow 19' dispersed from the device is not as heavily ionized as might otherwise be possible.

Figure 2:
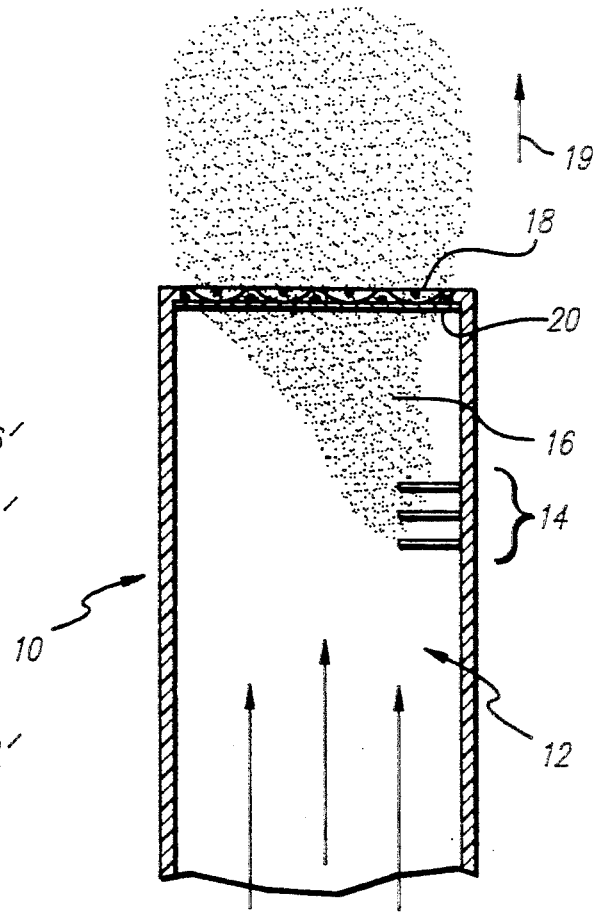
FIG. 2 is an expanded cross-sectional schematic view of an ionizing apparatus according to the present invention showing the dispersed flow of negatively ionized air molecules.

Turning to FIG. 2, one sees an expanded cross-sectional view of the apparatus 10 having an output passageway 12, according to the present invention, for producing a stream of air that contains negative ions. As in the prior art apparatus, air is forced past the three negatively charged ionizing needles 14 producing a cloud of ionized air 16. The ionized air molecules are at the same time pulled towards a conductive strip 20, placed around the interior periphery of the output grill 18. Note that the cloud of ionized air particles disperses before exiting at the output grill 18. This dispersion and the acceleration of the particles caused by the ionizing needle helps to create a larger size cloud of ionized particles exiting the apparatus 10'' in the output air stream indicated by arrow 19.

Figure 3:
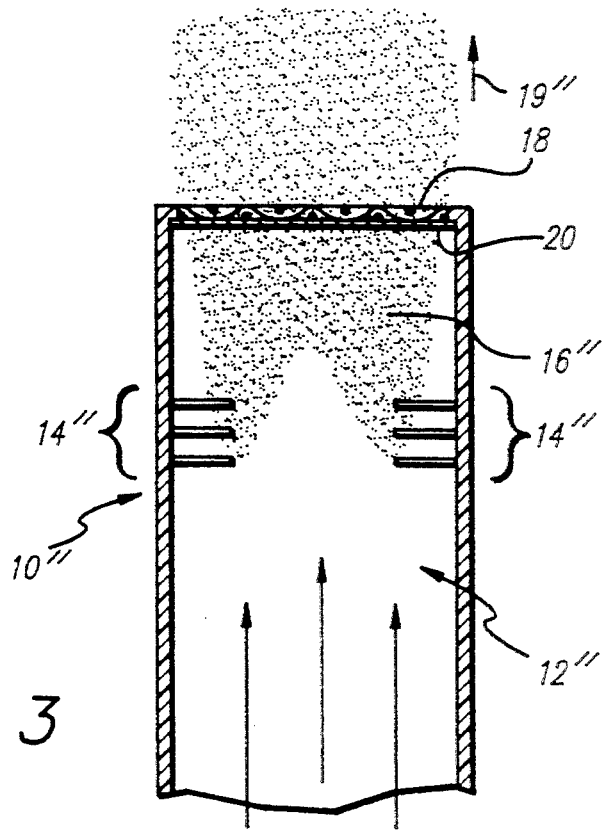
FIG. 3 is an expanded cross-sectional schematic view of an ionizing apparatus representing an alternate embodiment of the present invention.

FIG. 3 shows an alternate embodiment of the present invention. Again, the familiar feature of an air output duct 12'' with air forced into it is present. In this embodiment, however, the ionizing needles 14'' are located on either side of the output port, creating an expanded cloud of ionized molecules 16'' which are attracted by the conductive strip 20, placed around the interior periphery of the output grill 18 before exiting the output grill 18 in the output air stream indicated by arrow 19''.

Figure 4:
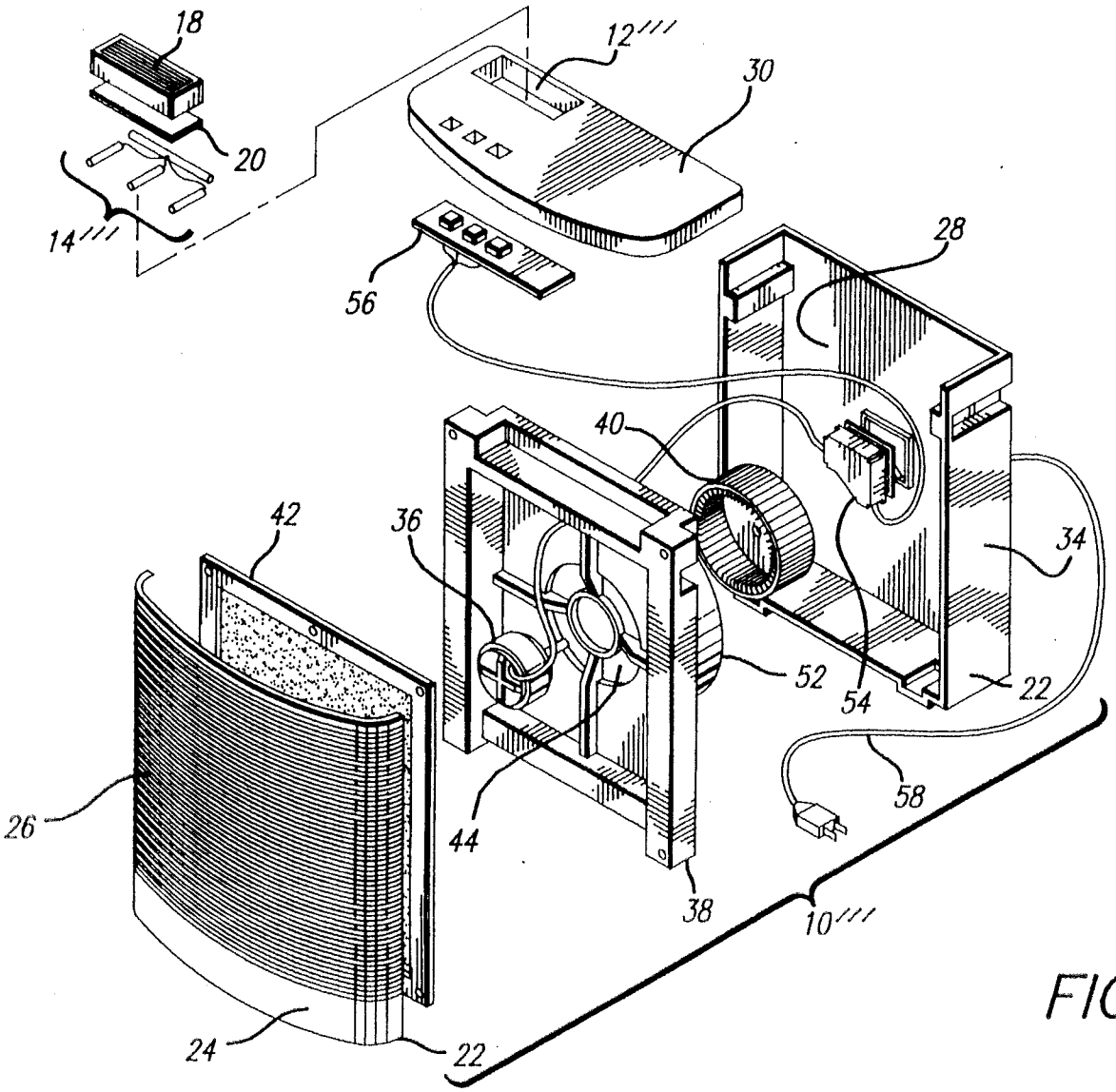
FIG. 4 is an expanded perspective view of an air filter utilizing an ionizing apparatus according to the present invention.

FIG. 4 shows an expanded perspective view of an air filtering device 10'' ' including a preferred embodiment of the present invention. A housing 22 includes a front face 24, with an air intake grill 26. Those skilled in the art will recognize that the rear face 28 of the housing 22 could also be constructed to include an air intake grill. The top face 30 of the housing 22 includes an air output passageway 12'''. This passageway could also be located on the side face 34.

An electric motor 36 is attached to the front side of a supporting frame 38. The motor shaft passes through an opening in the frame 38 and is attached to a blower or fan 40. When the motor 36 is activated, fan 40 draws air in through the air intake grill 26 and filter 42. The air is further drawn through the vents 44 in the supporting frame 38 where it encounters the fan 40 which drives it through a scroll shaped air duct 52 to the output duct 12'''. At output duct 12''', the air passes by three ionizing needles 14''' charged to −5,000 volts DC relative to ground and then through an electrically conductive strip 20 which stretches around the periphery of the output grill 18. The output grill is itself made from a non-conductive plastic material. The conductive strip 20 is charged at +110 volts DC with respect to ground.

A control box 54 is mounted on the frame of the device 10'''. Cables extend from the control box 54 to a printed circuit board 56 that is positioned beneath the top plate 30, to the motor 36 and also to a cord 58 for attachment to a wall outlet.

Although a preferred embodiment of the invention has been described in detail in order to comply with the patent laws, it will be understood that the scope of the invention is to be limited only in accordance with the appended claims.

What is claimed is:

1. An apparatus, positioned in the output passageway of an air filter, wherein said output passageway includes inlet and outlet ends and said air filter injects a stream of air into said passageway, for producing a stream of air that contains a substantial quantity of negative ions, said apparatus comprising:

grill means covering said outlet end of said passageway for permitting the exit of said stream of air while protecting human hands from inadvertent insertion into the interior of said passageway;

an electrically conductive strip extending around substantially all of the interior periphery of said grill means;

at least one ionizing needle supported and projecting laterally into the interior of said passageway, a predetermined distance from said electrically conductive strip, and having a sharp point extending toward the central portion of said passageway;

an electric circuit with means for producing a DC voltage difference of about five thousand volts between its positive and negative terminals;

said ionizing needle being connected with said negative terminal of said electric circuit and thereby maintained with a negative charge of about five thousand volts with respect to ground and with respect to said electrically conductive strip which is connected with said positive terminal of said electric circuit; and wherein the cross-sectional area of said passageway, the volume of air per unit of time at which the air filter injects air into the passageway, and the length of said predetermined distance are such that a substantial portion of negative ions generated from said ionizing needle are swept by the air stream past said electrically conductive strip and out of said outlet end of said passageway.

2. Apparatus as in claim 1 wherein said positive terminal is maintained at a fixed voltage between 0 and +100 volts DC.

3. Apparatus as in claim 1 wherein said electrically conductive strip extends entirely around the interior periphery of said grill means.

* * * * *